US005649468A

United States Patent [19]

Tsurumi et al.

[11] Patent Number: 5,649,468

[45] Date of Patent: Jul. 22, 1997

[54] SWASH PLATE TYPE HYDRAULIC MOTOR HAVING OFFSET SWASH PLATE PIVOT AXIS

[75] Inventors: Kou Tsurumi; Shinichi Hamada, both of Osaka, Japan

[73] Assignee: Kubota Corporation, Osaka, Japan

[21] Appl. No.: 329,121

[22] Filed: Oct. 25, 1994

[30] Foreign Application Priority Data

Mar. 2, 1994 [JP] Japan ..... 6-031737
Aug. 24, 1994 [JP] Japan ..... 6-199220

[51] Int. Cl.[6] ..... F01B 3/00; F01B 13/04

[52] U.S. Cl. ..... 91/506; 91/505; 92/12.2

[58] Field of Search ..... 91/505, 506; 92/12.2; 417/269

[56] References Cited

U.S. PATENT DOCUMENTS

| | | | |
|---|---|---|---|
| Re. 26,519 | 1/1969 | D'Amato | 91/505 |
| 2,870,746 | 1/1959 | Keel . | |
| 3,009,422 | 11/1961 | Davis . | |
| 3,070,031 | 12/1962 | Puryear . | |
| 3,199,461 | 8/1965 | Wolf | 91/506 |
| 3,319,419 | 5/1967 | Hann . | |
| 3,665,814 | 5/1972 | Ankeny . | |
| 3,722,370 | 3/1973 | Aplin . | |
| 3,747,476 | 7/1973 | Ankeny . | |
| 4,168,653 | 9/1979 | Hein et al. | 92/12.2 |
| 4,690,036 | 9/1987 | Kosaka . | |
| 4,825,753 | 5/1989 | Inoue et al. | 91/505 |
| 5,095,807 | 3/1992 | Wagenseil | 92/12.2 |

FOREIGN PATENT DOCUMENTS

| | | | |
|---|---|---|---|
| 0 163 995 | 12/1985 | European Pat. Off. . | |
| 0 433 730 | 6/1991 | European Pat. Off. . | |
| 1269286 | 7/1961 | France | 91/505 |
| 32 21 682 | 12/1983 | Germany . | |
| 998577 | 7/1965 | United Kingdom . | |
| 1304 103 | 1/1973 | United Kingdom . | |
| 2 010 387 | 6/1979 | United Kingdom . | |
| 2 064 674 | 6/1981 | United Kingdom . | |

*Primary Examiner*—Timothy Thorpe
*Assistant Examiner*—Roland G. McAndrews, Jr.
*Attorney, Agent, or Firm*—Townsend and Townsend and Crew LLP

[57] ABSTRACT

A swash plate type hydraulic motor switchable between high speed and low speed, comprises a main case, a cylinder block supported in the main case to be rotatable about a rotational axis, the cylinder block including a plurality of plungers having longitudinal axes extending parallel to the rotational axis, a swash plate supported in the main case for contacting forward ends of the plungers and pivotable about a pivotal axis between a high speed position and a low speed position, the pivotal axis extending parallel to a plane perpendicular to the rotational axis, and two trunnions projecting on the pivotal axis from opposite peripheral positions of the swash plate. The pivotal axis is located in a region between and close to a first reference plane extending perpendicular to a plane defined by the forward ends of the plungers in the low speed position, intersecting the rotational axis, and extending parallel to the pivotal axis, and a second reference plane extending perpendicular to a plane defined by the forward ends of the plungers in the high speed position, intersecting the rotational axis, and extending parallel to the pivotal axis.

5 Claims, 7 Drawing Sheets

SWASH PLATE TYPE HYDRAULIC MOTOR HAVING OFFSET SWASH PLATE PIVOT AXIS

BACKGROUND OF THE INVENTION

1. Field of the Invention

The present invention relates to a swash plate type hydraulic motor switchable between high speed and low speed, including, a main ease, a cylinder block supported in the main ease to be rotatable about a rotational axis, the cylinder block supporting a plurality of plungers having longitudinal axes extending parallel to the rotational axis, a swash plate supported in the main case for contacting forward ends of the plungers and pivotable about a pivotal axis between a high speed position and a low speed position, the pivotal axis extending parallel to a plane perpendicular to the rotational axis, and a swash plate angle switching device for switching the swash plate to one of the high speed position and low speed position.

2. Description of the Related Art

A hydraulic motor switchable between high speed and low speed as noted above is disclosed in U.S. Pat. No. 4,690,036, for example. This hydraulic motor includes a swash plate angle adjusting device having spherical elements mounted in a deep inward region of a drive chamber defined by the main case, for engaging and supporting the swash plate. The swash plate is pivotable about a transverse axis of the spherical elements. The main ease includes a hydraulic cylinder for pressing the swash plate at a side facing away from the plungers to tilt the swash plate.

In this swash plate angle adjusting structure, the swash plate is engaged and supported only by the spherical elements in the deep end of the drive chamber. No means is provided to inhibit the swash plate from lifting or becoming loose toward the cylinder block. When the plungers of the cylinder block exert a smaller pressing force than the swash plate angle varying hydraulic cylinder, the swash plate could become loose from the spherical elements, thereby to be pivotable in an unsteady way. To avoid such an inconvenience in practice, the pivotal axis of the swash plate must be offset to a large extent from a rotational axis of the motor so that, based on the pressing force of the plungers of the cylinder block, a sufficient tilting moment is constantly applied to the swash plate in a fixed direction (toward the low speed position).

However, in the structure in which the pivotal axis of the swash plate is sufficiently offset from the rotational axis of the motor to prevent the swash plate from becoming loose, the hydraulic cylinder must apply a strong pressing force to cause the swash plate to pivot to the high speed position. This requires the hydraulic cylinder to have a large diameter. In addition, complicated setting of hydraulic circuitry is required, such as for suitably balancing the pressing forces of the plungers and hydraulic cylinder, in order to stabilize postures of the swash plate. To meet his requirement, the components must have a high degree of precision, which has been a cause of the high manufacturing cost.

SUMMARY OF THE INVENTION

The object of the present invention is to provide a swash plate type hydraulic motor which does not require a strong operating force to switch a swash plate between a high speed position and a low speed position, or complicated hydraulic circuitry to attain a high degree of hydraulic balance.

The above object is fulfilled, according to the present invention, by a swash plate type hydraulic motor switchable between high speed and low speed, as noted at the outset hereof, in which the swash plate includes two trunnions projecting on the pivotal axis from opposite peripheral positions of the swash plate, and the pivotal axis is located in a region between and close to a first reference plane extending perpendicular to a plane defined by the forward ends of the plungers in the low speed position, intersecting the rotational axis, and extending parallel to the pivotal axis, and a second reference plane extending perpendicular to a plane defined by the forward ends of the plungers in the high speed position, intersecting the rotational axis, and extending parallel to the pivotal axis.

According to the above construction, the pivotal axis of the swash plate is located in a region between and close to the first reference plane corresponding to the low speed position, and the second reference plane corresponding to the high speed position. A resultant of components of force of the plungers acting to push the swash plate at right angles passes through the vicinity of the pivotal axis of the swash plate whether the swash plate is in the low speed position or in the high speed position. Consequently, when the swash plate is moved from the low speed position to the high speed position and vice versa, the resultant of components of force pushing the swash plate at right angles has a small moment. Further, since the swash plate angle switching device moves the swash plate from the low speed position to the high speed position and vice versa, a reliable and stable operability is assured. The switching operation requires only a small operating force as noted above, which allows a simplified construction of the swash plate angle switching device.

In a preferred embodiment of the present invention, the swash plate angle switching device includes two hydraulic cylinders arranged at opposite sides of the pivotal axis.

In a further embodiment of the invention applicable, for example, to a working vehicle such as a backhoe, the pivotal axis of the swash plate may be located on or very close to the first reference plane. Then, the swash plate is switchable between the low speed position and high speed position with a relatively small operating force. In addition, the swash plate is biased toward the low speed position which is used more frequently than the high speed position. This produces an effect of inhibiting the swash plate set to the low speed position during an earth moving operation, from moving from the low speed position to the high speed position owing to vibration or shocks.

Other features and advantages of the invention will become more apparent from the following description of embodiments of the invention taken with reference to the accompanying drawings.

DETAILED DESCRIPTION OF THE PREFERRED EMBODIMENTS

Figure 1:
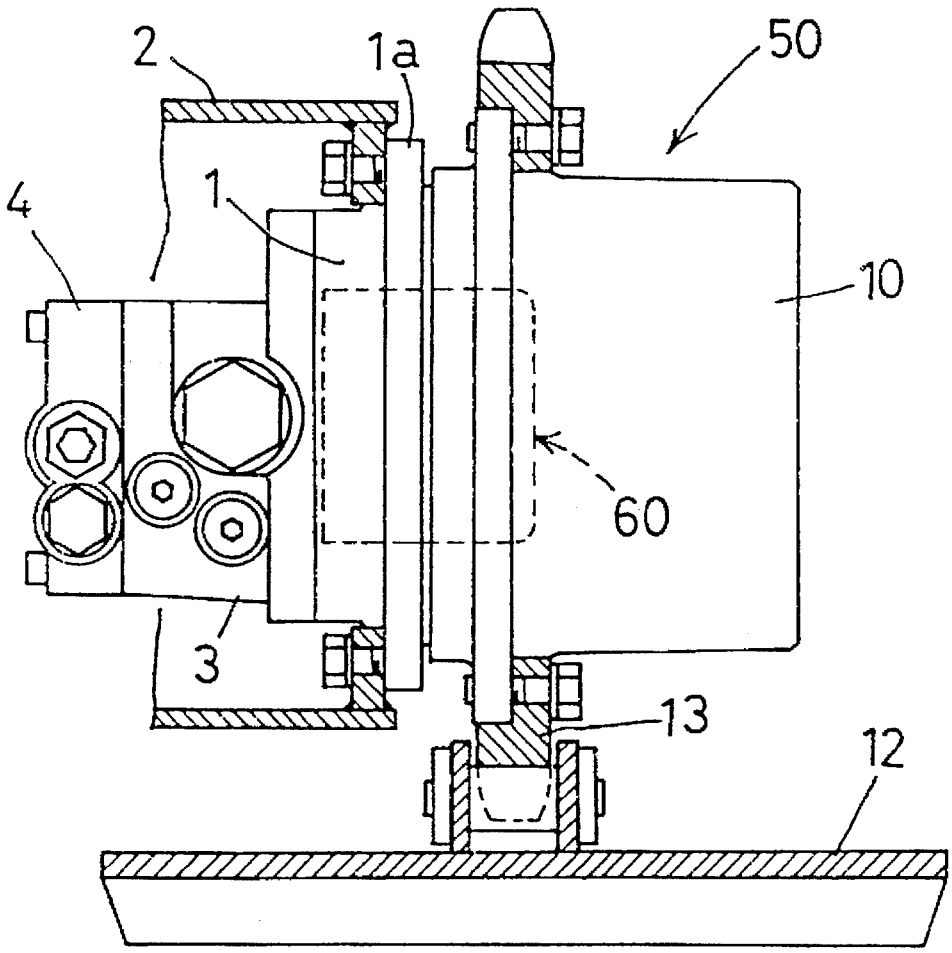
FIG. 1 is a side view of a swash plate type hydraulic motor according to the present invention as attached to a crawler running device.

FIG. 1 shows a swash plate type hydraulic motor 50 switchable between high speed and low speed according to the present invention, as used for drying a crawler running device of a construction machine such as a backhoe.

The hydraulic motor 50 includes a main case 1 connected to a track frame 2 through a flange 1*a*. The main case 1 defines a drive chamber 60 opening toward the track frame 2, which is closed by two hydraulic blocks 3 and 4 in series connection. A rotary case 10 has a drive sprocket 13 connected thereto and engaged with a crawler belt 12.

Figure 2:
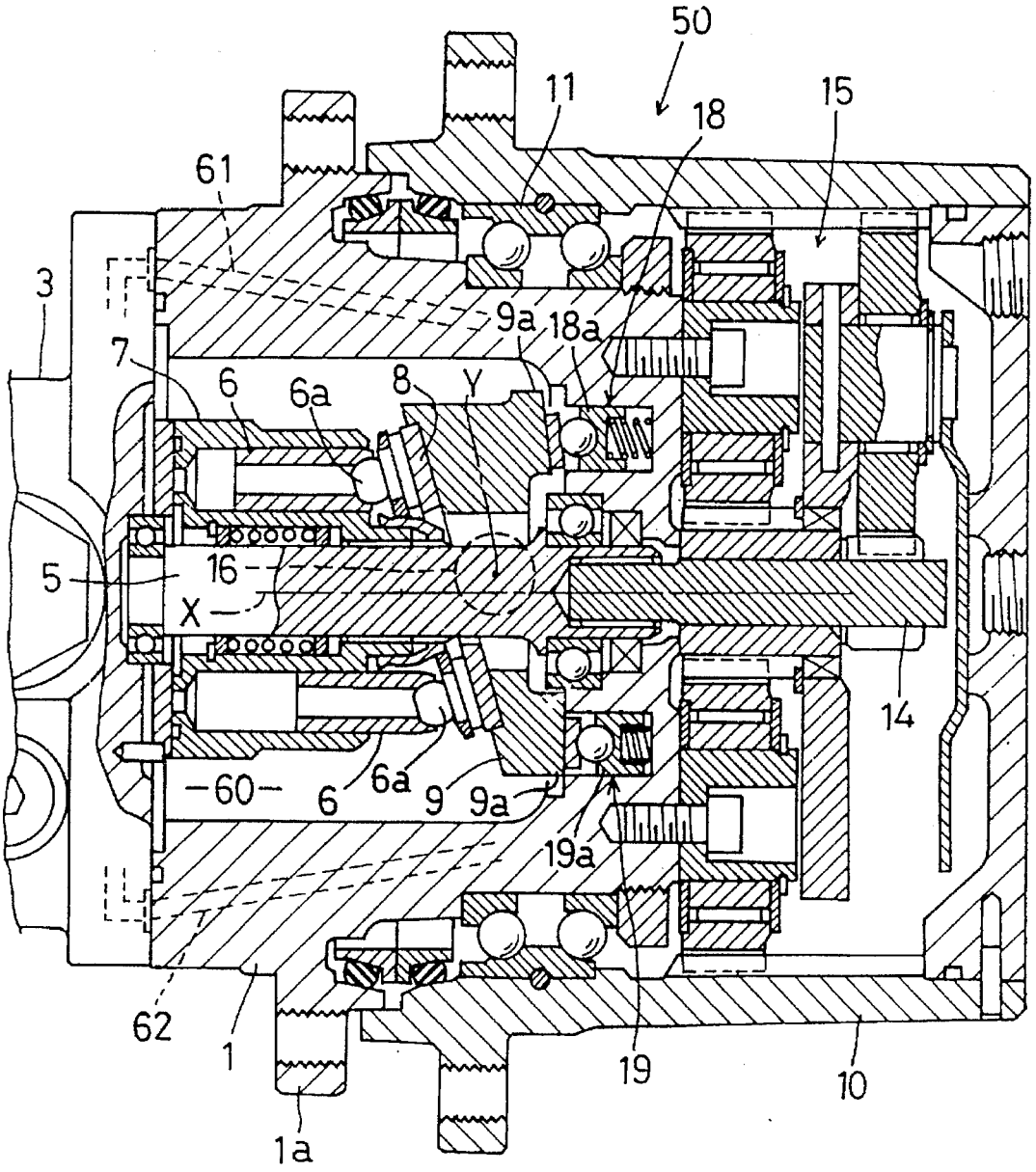
FIG. 2 is a side view in vertical section of the hydraulic motor in a low speed position.

As shown in FIG. 2, a rotary shaft 5 extends horizontally and centrally of the drive chamber 60. The rotary shaft 5 supports a cylinder block 7 fixed thereto and having a plurality of axial plungers 6 arranged peripherally thereof to be slidable parallel to a rotational axis X of the rotary shaft 5. A swash plate 9 is mounted in the drive chamber 60 for receiving revolving heads 6*a* of the plungers 6 through a thrust plate 8.

As shown in FIG. 2, the rotary case 10 is rotatably mounted on the main case 1 through bearings 11. An output shaft 14 is mounted in the main case 1 and connected coaxially to the rotary shaft 5. The output shaft 14 is operatively connected to the rotary case 10 through a planetary gear reduction mechanism 15.

Figure 3:
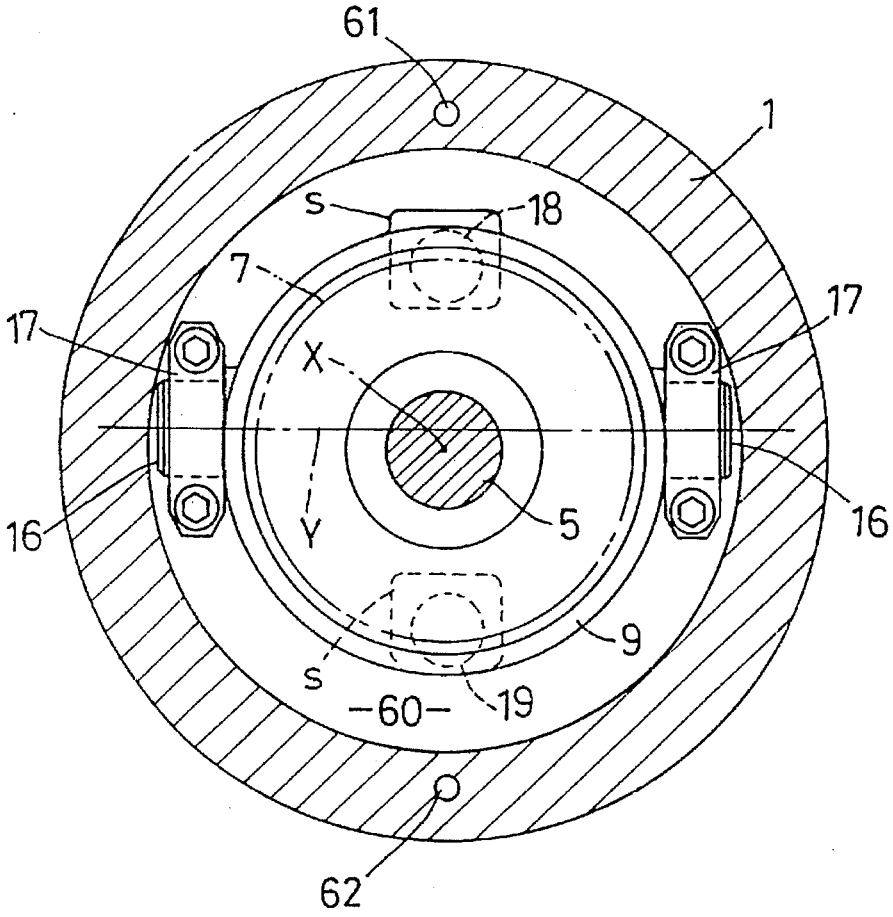
FIG. 3 is a front view in vertical section of a drive chamber as seen from the left side of FIG. 2.
Figure 4:
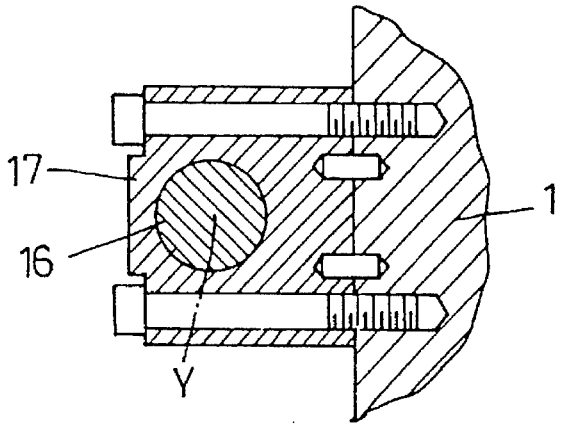
FIG. 4 is a fragmentary side view in vertical section showing a structure for supporting a trunnion of a swash plate.
Figure 5:
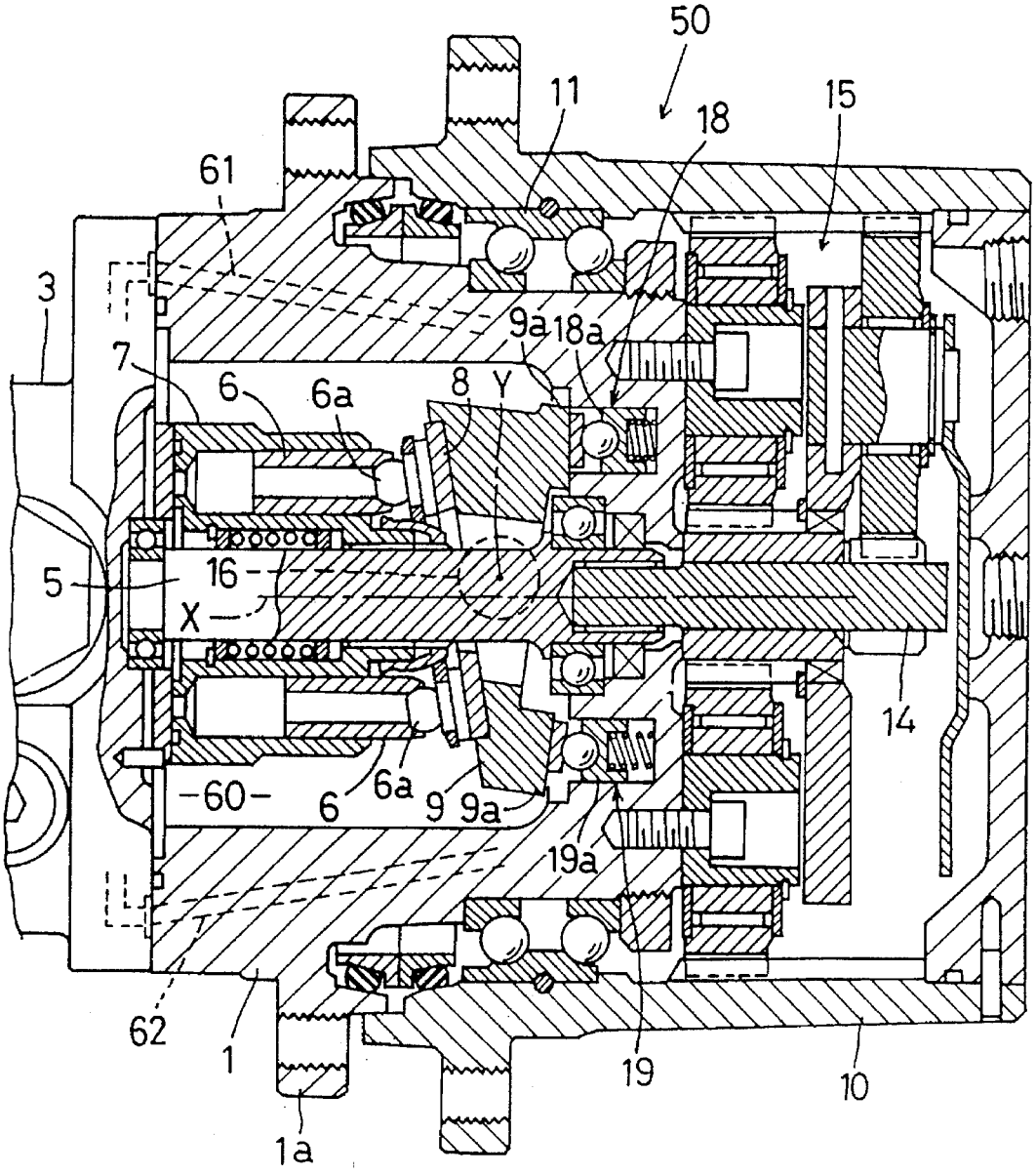
FIG. 5 is a side view in vertical section of the hydraulic motor in a high speed position.

As shown in FIGS. 2 through 4, the swash plate 9 includes a pair of trunnions 16 fixed to peripheral positions thereof. The trunnions 16 are rotatably fitted and supported in a pair of bearing blocks 17 removably belted to inward walls of the drive chamber 60. The swash plate 9 is supported to be pivotable about a support axis Y of the trunnions 16 between a low speed position shown in FIG. 2 and a high speed position shown in FIG. 5. That is, FIGS. 2 and 5 show the same swash plate type hydraulic motor 50 according to the present invention, and FIG. 2 shows the swash plate 9 in the low speed position while FIG. 5 shows the swash plate 9 in the high speed position.

The position of the pivotal axis: Y of the swash plate 9 will be described with reference to FIG. 6 schematically showing the motor 50.

Figure 9:
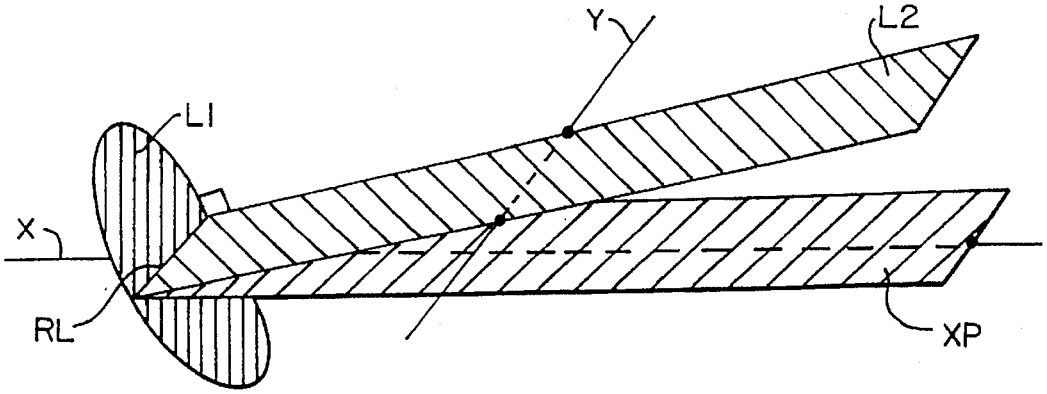
FIG. 9 is a simplified perspective view showing a first reference plane L2, a rotation axis X, a pivotal axis Y, a plunger plane L1, an X-axis plane XP and a reference line RL.
Figure 10:
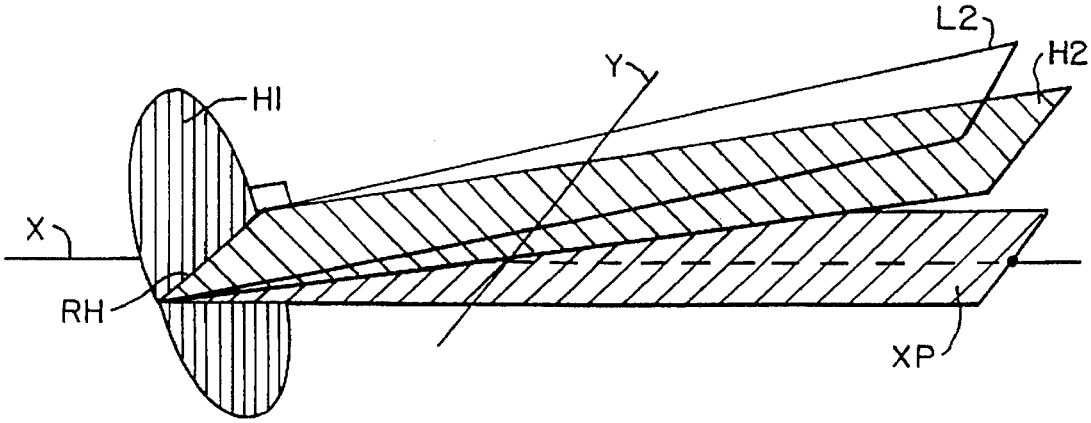
FIG. 10 is a figure similar to FIG. 9, but includes a second reference plane H2 between the X-axis plane XP and the first reference plane L2 and replacing plane L1 with plane H1.

It is assumed here that a first reference plane: L2 extends perpendicular to a plane defined by forward ends of the plungers 6 in the low speed position of the swash plate 9 shown in FIG. 2. This first reference plane: L2 also intersects the rotational axis: X, and extends parallel to the pivotal axis: Y see FIG. 9. Further, a second reference plane: H2 (see FIG. 9) extends perpendicular to a plane defined by the forward ends of the plungers 6 in the high speed position of the swash plate 9 shown in FIG. 5. This second reference plane: H2 also intersects the rotational axis: X, and extends parallel to the pivotal axis: Y. In the present invention, it is important that the pivotal axis: Y of the swash plate 9 is located in a region between and close to the first reference plane: L2 and second reference plane: H2. In FIG. 6, the pivotal axis: Y is located substantially halfway between the first reference plane: L2 and second reference plane: H2. In FIG. 7, the pivotal axis: Y is located on the first reference plane: L2. A resultant of components of force applied by the plungers 6 to the swash plate 9 in the low speed position to push the swash plate 9 at right angles is considered to exist on the first reference plane: L2. A resultant of components of force applied by the plungers 6 to the swash plate 9 in the high speed position to push the swash plate 9 at right angles is considered to exist on the second reference plane: H2.

Figure 6:
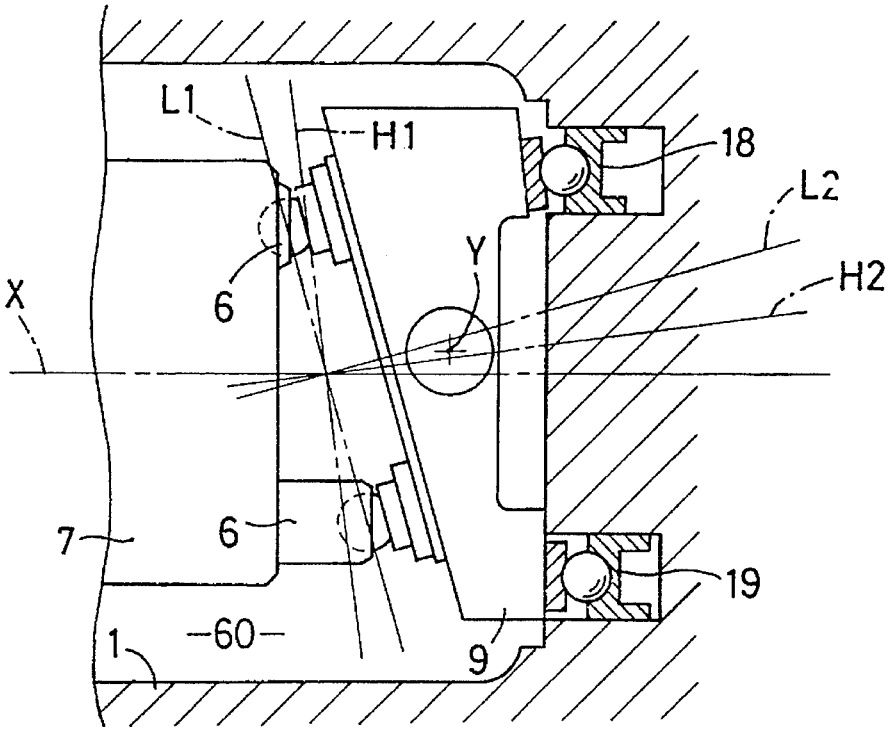
FIG. 6 is a schematic view showing a position of a pivotal axis of the swash plate.
Figure 7:
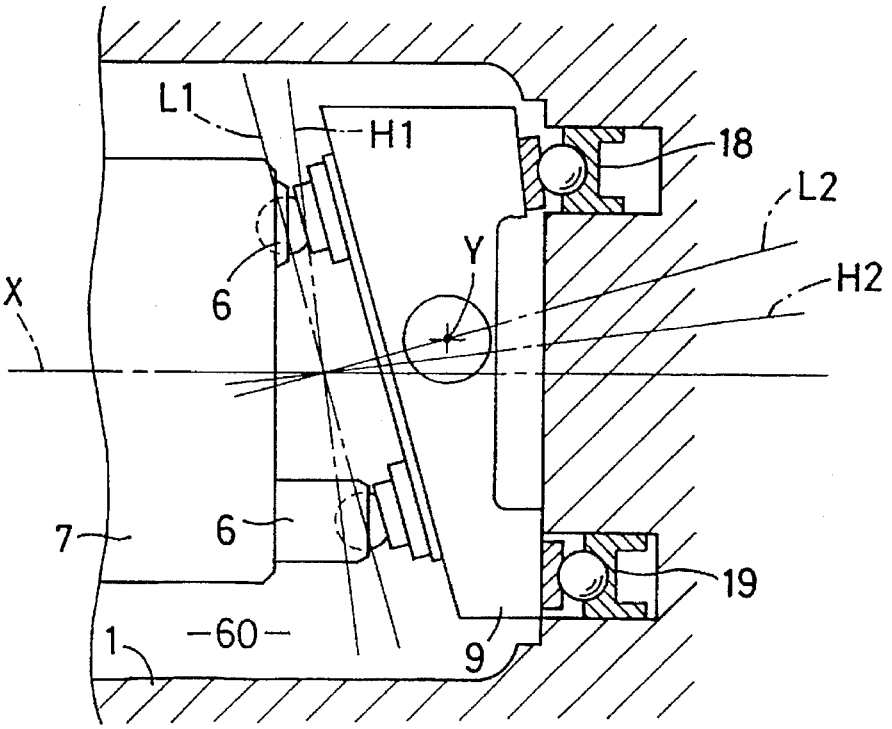
FIG. 7 is a schematic view showing a modified position of the pivotal axis of the swash plate.

Where, as shown in FIG. 6, for example, the pivotal axis: Y of the swash plate 9 is located between the first reference plane: L2 and second reference plane: H2, the resultant of components of force of the plungers 6 acting to push the swash plate 9 at right angles passes through the vicinity of pivotal axis: Y whether the swash plate 9 is in the low speed position or in the high speed position. Consequently, when hydraulic cylinders 18 and 19 are driven to move the swash plate 9 from the low speed position (an inclined posture referenced L1) to the high speed position (an inclined posture referenced H1), the resultant of components of force pushing the swash plate 9 at right angles has a small moment acting in an opposite direction to the above angular movement of the swash plate 9. Thus, when the swash plate 9 is moved from the low speed position to the high speed position and vice versa, the resultant of components of force pushing the swash plate 9 at right angles has a small moment.

Next, the case shown in FIG. 7 will be described, in which the pivotal axis: Y of the swash plate 9 is located on or very close to the first reference plane: L2. In this case, when the swash plate 9 is in the low speed position (inclined posture L1), the resultant of components of force of the plungers 6 acting to push the swash plate 9 at right angles coincides with the first reference plane: L2 (i.e. the pivotal axis: Y of the swash plate 9). Consequently, when the hydraulic cylinders 18 and 19 are driven to move the swash plate 9 from the low speed position (inclined posture L1) to the high speed position (inclined posture H1), the resultant of components of force pushing the swash plate 9 at right angles has a moment which initially does not act in an opposite direction to the angular movement of the swash plate 9, and at a later stage begins to act in the opposite direction. Such a moment is therefore small. Conversely, when the swash plate 9 is in the high speed position (inclined posture H1), the resultant of components of force of the plungers 6 acting to push the swash plate 9 at right angles coincides with the second reference plane: H2, thereby biasing the swash plate 9 toward the low speed position (inclined posture L1). Consequently, when the hydraulic cylinders 18 and 19 are driven to move the swash plate 9 from the high speed position (inclined posture H1) to the low speed position (inclined posture L1), the resultant of components of force pushing the swash plate 9 at right angles has a moment acting in the same direction as the angular movement of the swash plate 9, to facilitate the angular movement.

As shown in FIGS. 2 and 3, the main body 1 has oil passages 61 and 62 formed in upper and lower positions thereof in the drawings across the axis Y of the trunnions 16, and extending to the two hydraulic cylinders 18 and 19. When pressure oil is supplied only to the hydraulic cylinder 18 to advance a plunger 18*a*, the swash plate 9 is set to the low speed position at a large angle as shown in FIG. 2.

Conversely, when pressure oil is supplied only to the hydraulic cylinder 19 to advance a plunger 19*a*, the swash plate 9 is set to the high speed position at a small angle as shown in FIG. 5. The swash plate 9 has seats 9*a* having a relatively small area and elevated from rear surfaces thereof for contacting inward end surfaces of the drive chamber 60 to determine tilt angles of the swash plate 9. The seats 9*a* also have a function to receive the plungers 18*a* and 19*a*. Each plunger 18*a* or 19*a* has a head of flexible contact structure utilizing a ball.

Figure 8:
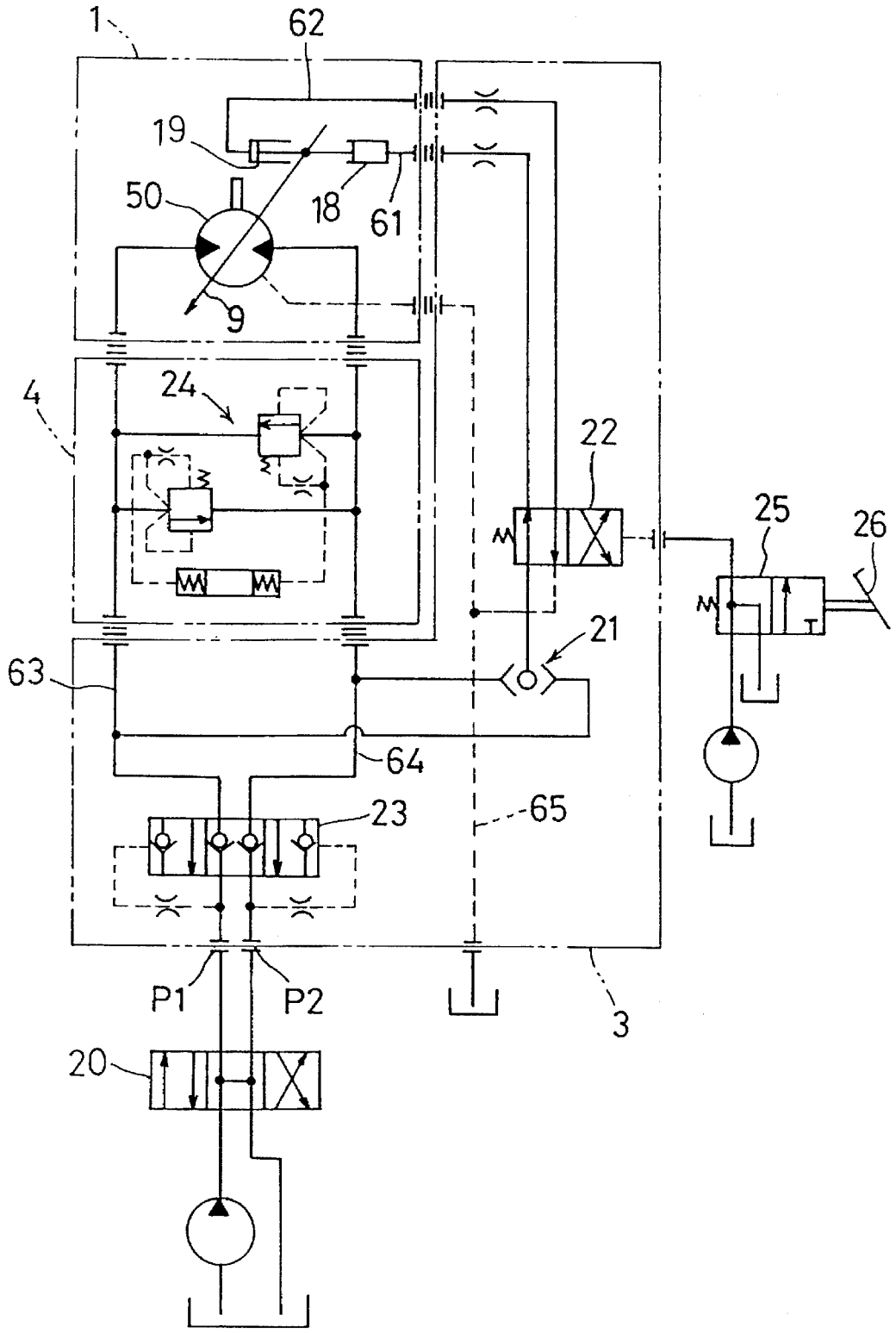
FIG. 8 is a diagram of hydraulic circuitry for controlling the hydraulic motor according to the present invention.

The swash plate type hydraulic motor 50 is driven by hydraulic circuitry shown in FIG. 8.

The hydraulic circuitry includes a propelling control valve 20 operably by a switch lever (not shown) to selectively supply pressure oil to a port P1 or P2 to rotate the hydraulic motor 50 forward or backward. The circuitry further includes a high pressure selecting shuttle valve 21 connected to a forward drive oil line 63 and a reverse oil line 64. The shuttle valve 21 supplies forward or backward drive pressure oil to the hydraulic cylinder 18 or 19.

A hydraulic pilot type line selector valve 22 is disposed between the shuttle valve 21 and hydraulic cylinders 18 and 19. In a state free from pilot pressure, the selector valve 22 supplies pressure oil from the shuttle valve 21 to the oil line 61 leading to the hydraulic cylinder 18, and communicates the oil line 62 leading to the other hydraulic cylinder 19 with a drain oil line 65. Upon application of the pilot pressure, the selector valve 22 supplies the pressure oil from the shuttle valve 21 to the oil line 62 leading to the hydraulic cylinder 19, and communicates the oil line 61 leading to the other hydraulic cylinder 18 with the drain oil line 65.

The shuttle valve 21, line selector valve 22 and a counterbalance valve 23 are incorporated into the hydraulic block 3, while a shockless mechanism 24 is incorporated into the hydraulic block 4.

Normally, the line selector valve 22 is free from the pilot valve, and the pressure oil is supplied only to the hydraulic cylinder 18 for low speed, to maintain the swash plate 9 in the low speed position shown in FIG. 2.

When a pilot valve 25 is switched by depression of a pedal 26 to apply the pilot pressure to the line selector valve 22, the selector valve 22 is switched to supply the pressure oil only to the hydraulic cylinder 19 for high speed. Then, the swash plate 9 pivots about the support axis Y to the high speed position. When the foot is removed from the pedal 26, pressure oil is supplied only to the hydraulic cylinder 18 for low speed, as noted above, whereby the swash plate 9 pivots about the support axis Y to the low speed position.

What is claimed is:

1. A swash plate type hydraulic motor switchable between high speed and low speed, comprising:

a main case;

a cylinder block supported in said main case to be rotatable about a rotational axis (X), said cylinder block including a plurality of plungers having longitudinal axes extending parallel to said rotational axis (X);

a swash plate supported in said main case for contacting forward ends of said plungers and pivotable about a pivotal axis (Y) between a high speed position and a low speed position, said pivotal axis (Y) extending perpendicular to said rotational axis (X);

two trunnions projecting on said pivotal axis (Y) from opposite peripheral portions of said swash plate;

swash plate angle switching means for switching said swash plate to one of said high speed position and said low speed position;

characterized in that said pivotal axis (Y) extends offset from said rotational axis (X);

and in that said pivotal axis (Y) is located between a first reference plane (L2) and a second reference plane (H2), wherein;

said first reference plane (L2) being a plane extending perpendicular to a first plunger plane (L1) and extending from a reference line (RL) toward said swash plate; said first plunger plane (L1) being a plane defined by said forward ends of said plungers in said low speed position; said reference line (RL) being an intersection line where said plunger plane (L1) and a plane (XP) intersect; and, said plane (XP) extending on said rotational axis (X) and parallel to said pivotal axis (Y);

said second reference plane (H2) being a plane extending perpendicular to a second plunger plane (H1) and extending from a second reference line (RH) toward said swash plate; said second plunger plane (H1) being a plane defined by said forward ends of said plungers in said high speed position; said second reference line (RH) being an intersection line where said second plunger plane (H1) and said plane (XP) intersect; and wherein said second reference plane (H2) lies between said first reference plane (L2) and said plane (XP).

2. A hydraulic motor as defined in claim 1, wherein said swash plate angle switching means includes at least one hydraulic cylinder.

3. A hydraulic motor as defined in claim 1, wherein said swash plate angle switching means includes at least one hydraulic cylinder.

4. A hydraulic motor as defined in claim 3, wherein said swash plate angle switching means includes two hydraulic cylinders arranged substantially symmetrically about said pivotal axis.

5. A swash plate type hydraulic motor switchable between high speed and low speed, comprising:

a main case;

a cylinder block supported in said main case to be rotatable about a rotational axis (X), said cylinder block including a plurality of plungers having longitudinal axes extending parallel to said rotational axis (X);

a swash plate supported in said main case for contacting forward ends of said plungers and pivotable about a pivotal axis (Y) between a high speed position and a low speed position, said pivotal axis (Y) extending perpendicular to said rotational axis (X);

two trunnions projecting on said pivotal axis (Y) from opposite peripheral portions of said swash plate;

swash plate angle switching means for switching said swash plate to one of said high speed position and said low speed position;

characterized in that said pivotal axis (Y) extends offset from said rotational axis (X);

and in that said pivotal axis (Y) is substantially located on a first reference plane (L2), wherein;

said first reference plane (L2) being a plane extending perpendicular to a plunger plane (L1) and extending from a reference line (RL) toward said swash plate; said plunger plane (L1) being a plane defined by said forward ends of said plungers in said low speed position; said reference line (RL) being an intersection line where said plunger plane (L1) and a plane (XP) intersect; and, said plane (XP) extending on said rotational axis (X) and parallel to said pivotal axis (Y).

* * * * *